US005762267A

United States Patent [19]

Riser

[11] Patent Number: 5,762,267

[45] Date of Patent: Jun. 9, 1998

[54] HEATING DEVICE WHICH CAN BE USED FOR INSTALLATION IN A CABIN OF A CABIN RAILWAY

[75] Inventor: Georges Riser, Böckten, Switzerland

[73] Assignee: CWA-Constructions S.A., Olten, Switzerland

[21] Appl. No.: 699,270

[22] Filed: Aug. 19, 1996

[30] Foreign Application Priority Data

Aug. 25, 1995 [CH] Switzerland ..... 2432/95

[51] Int. Cl.[6] ..... B60H 1/00

[52] U.S. Cl. ..... 237/28; 237/2 A; 237/12.3 C

[58] Field of Search ..... 237/2 A, 12.3 C

[56] References Cited

U.S. PATENT DOCUMENTS

| | | | |
|---|---|---|---|
| 4,821,796 | 4/1989 | Schulz | 165/122 |
| 4,836,444 | 6/1989 | Kawamura | 237/2 A |
| 4,899,931 | 2/1990 | Isley | 237/12.3 C |
| 4,927,077 | 5/1990 | Okada | 237/2 A |
| 4,944,454 | 7/1990 | Widemann et al. | 237/12.3 C |
| 5,044,260 | 9/1991 | Avari | 98/40.28 |
| 5,121,739 | 6/1992 | Barker | 237/12.3 C |
| 5,456,408 | 10/1995 | Appel | 237/2 A |

*Primary Examiner*—Henry A. Bennett
*Assistant Examiner*—Derek S. Boles
*Attorney, Agent, or Firm*—Anderson, Kill & Olick, P.C.

[57] ABSTRACT

The heating device which can be used for installation in a cabin vehicle of a cabin railway consists essentially of a control means for regulating the interior cabin temperature and a fan device which serves for warming up the interior cabin air and has an air inlet, an air outlet and, arranged between the inlet and the outlet, a heating means for warming up the interior cabin air passed through the fan device. In a preferred embodiment of the invention, in particular the fan device and the heating means are arranged in a box which is provided, on each of two opposite end walls, with an air passage member intended for circulation of the interior cabin air and connected to the air inlet or air outlet. For example, this box is dimensioned and can be inserted into a frame opening of the inner base of the cabin in such a way that the stated air passage members project above the inner base of the cabin in the attached state.

5 Claims, 2 Drawing Sheets

HEATING DEVICE WHICH CAN BE USED FOR INSTALLATION IN A CABIN OF A CABIN RAILWAY

BACKGROUND OF THE INVENTION

1. Field of the Invention

The invention relates to a heating device which can be used for installation in a cabin of a cabin railway.

2. Description of the prior art

Swiss Patents 569,603, 626,842 and 670,224 disclose cabins for cabin railways, namely cableways, which have a cabin vehicle with a floor, two side walls, two end walls and a roof. One side wall of these cabins is provided with a door opening which can be closed with a single-leaf or double-leaf door. These known cabins have no heating devices for warming up the interior cabin air, so that the passengers in these cabins very often freeze when the outside temperatures are relatively low.

SUMMARY OF THE INVENTION

The present invention relates to a heating system which can be used for installation in a cabin of the type described above, namely a heating system which has a heating device for warming up and circulating the interior cabin air and a control means for regulating the interior cabin temperature, wherein the heating device in the form of a heat exchanger has a housing with an air inlet and an air outlet, in which housing a heating means for warring up the interior cabin air passed through the heating device is arranged between the air inlet and the air outlet, and wherein both the air inlet and the air outlet of the heating device are connected to the interior space of the cabin vehicle in the attached state.

The invention also relates to a cabin which serves for holding passengers.

BRIEF DESCRIPTION OF THE DRAWINGS

An embodiment of the invention is described below with reference to the drawings. In the drawings.

DESCRIPTION OF THE PREFERRED EMBODIMENT

Figure 1:
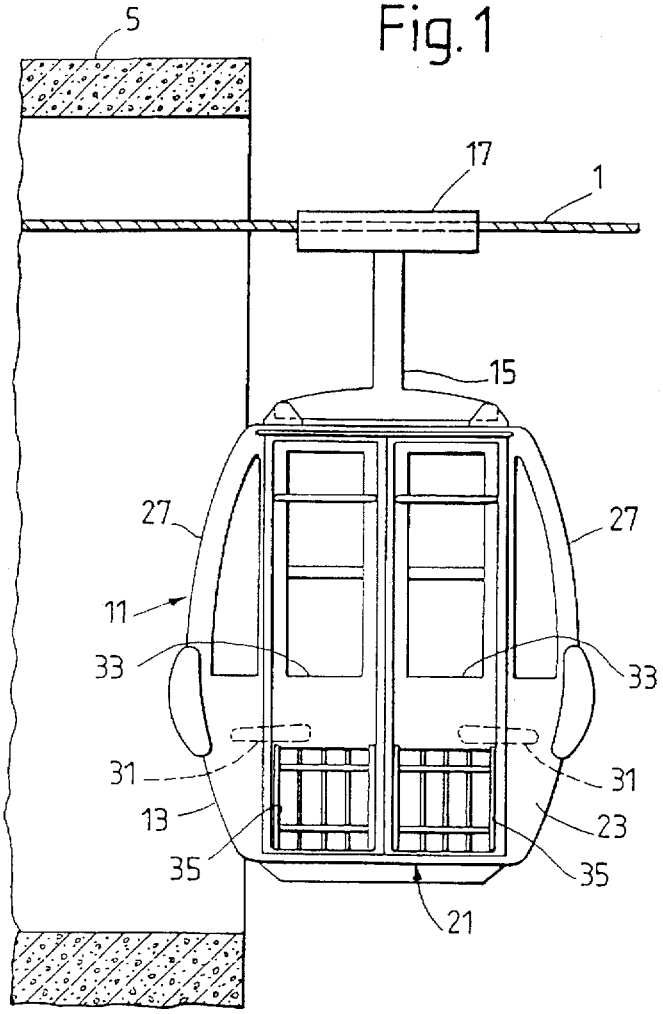
FIG. 1 shows a cabin railway with a schematically shown station and a cabin, with a view onto the side wall having the door opening.

FIG. 1 shows a cabin railway, namely a cableway, which has a cable 1 and a station which is denoted by 5. The cabin railway furthermore has cabin vehicles 11. Each of these has a cabin box 13 for holding the passengers and a suspension gear 15 with clamp 17 engaging the cable 1.

Figure 2:
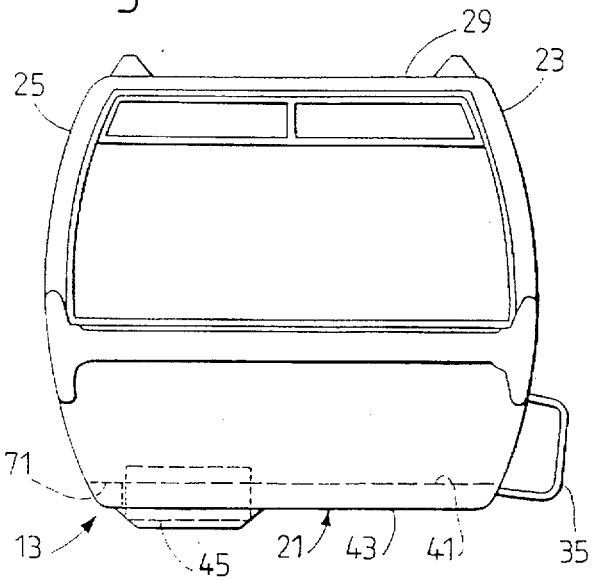
FIG. 2 shows a view of the cabin vehicle, looking onto one end wall.
Figure 3:
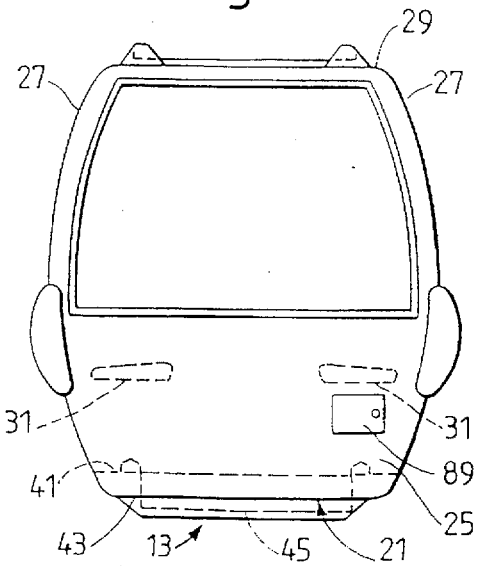
FIG. 3 shows a view of the cabin vehicle, looking onto the side wall which is without a door and faces the mast side.

The cabin box 13 shown separately in FIGS. 2 and 3 has a floor 21, two side walls 23 and 25 opposite one another, two end walls 27 and a roof 29. A seat 31, which may be in the form of, for example, a bench for four persons, is arranged at each end wall 27 in the interior of the cabin vehicle 11, so that a total of eight persons can thus sit in the cabin 11. The side wall 23 is provided with a door opening which can be closed by means of a door having two door leaves 33. Each door leaf 33 may have a window and may be provided on its outside with a ski and/or snow board holder 35.

Figure 4:
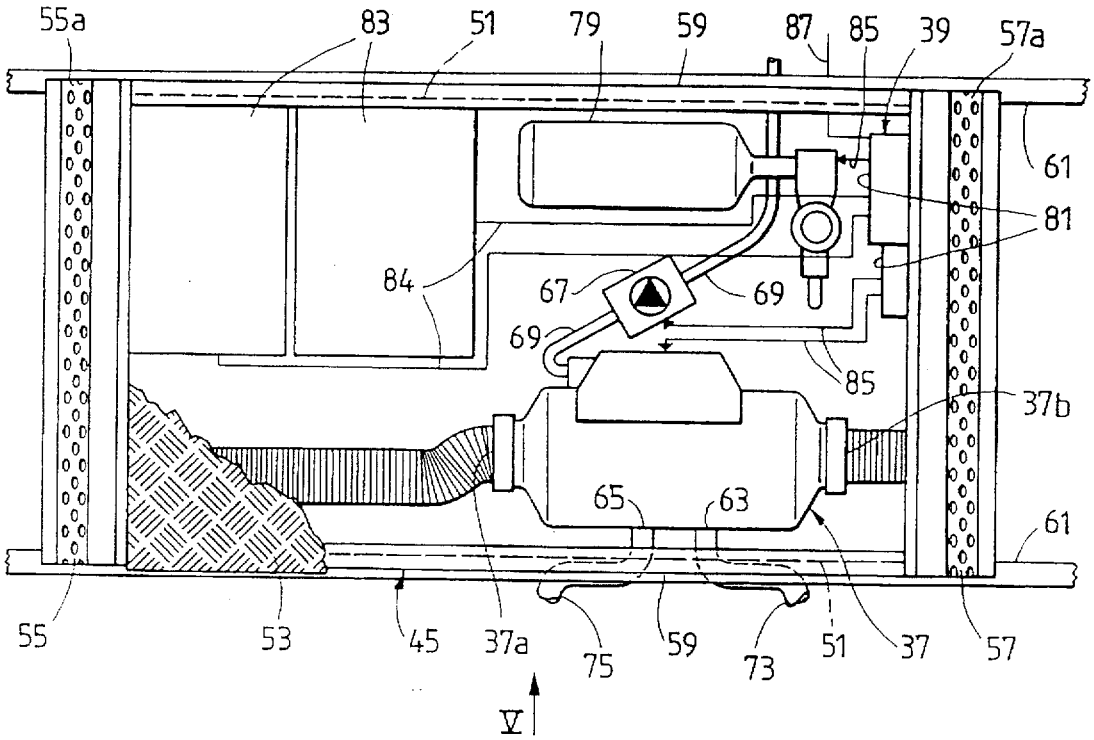
FIG. 4 shows a plan view of a part of the floor of the cabin shown in FIGS. 1 to 3, with a heating device arranged in the cabin floor.
Figure 5:
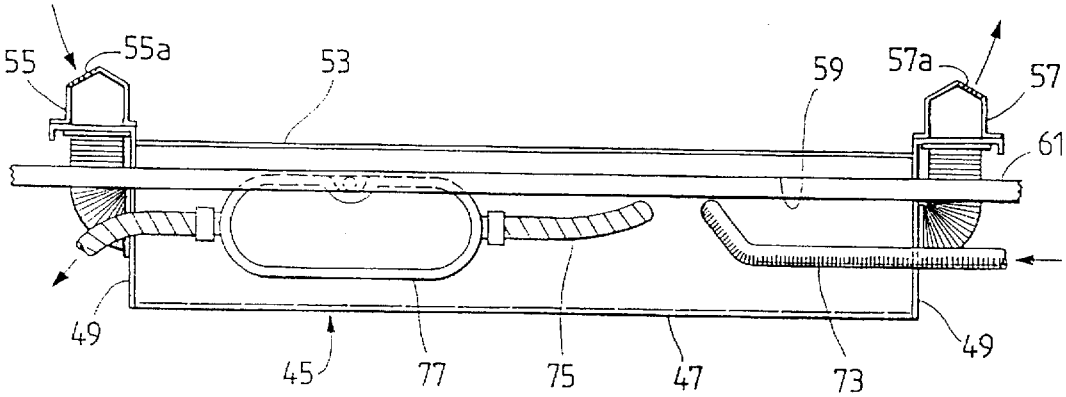
FIG. 5 shows a side view of the box shown in FIG. 4 and holding the heating device, in the direction v indicated by the arrow.

The cabin vehicle 11 is furthermore provided with a separate heating system shown in FIGS. 4 and 5. This consists essentially of a heating device 37 which serves for warming up and circulating the interior cabin air, is in the form of a heat exchanger and has an air inlet **37*a* and an air outlet 37*b* and a heating means, arranged between the inlet 37*a* and the outlet 37*b*, for warming up the interior cabin air passed through the heating device 37**.

The floor 21 of the cabin vehicle 11 has a skeleton-like structure (not shows) which is formed by profile rods and further parts and constitutes an inner base or floor 41 and an outer base 43. As is evident from the drawing, the heating system may be arranged mainly underneath the inner base 41 and its box 45 holding the fan device 37 and the control means 39 may project partly above the outer surface of the outer base 43. The box 45 which is rectangular in plan view has a base 47, two end walls 49, two side walls 51 opposite one another and a cover 53 which is detachably fastened to the end and side walls 49 and 51 and serves as a floor part. In addition, an air passage member 55 or 57 extending over the total length of the end Wall 49 and connected to the air inlet **37*a* or the air outlet 37*b*, respectively, of the heating device 37 is arranged at each end wall 49. Each air passage member 55 or 57 is furthermore formed by an elongated housing which has an intake grid 55*a* for interior air or a blow-out grid 57*a*** for warm air.

The box 45 is dimensioned and provided with retaining means in such a way that it can be inserted into a frame opening of the inner base 41, can be held thereon and if necessary can be fastened, for example the stated air passage members 55 and 57 resting under the two benches 31 of the cabin vehicle 11 in the attached state and projecting above the cabin floor 41 or the cover 53 of the box 45, i.e. into the interior space of the cabin.

Two girders 59 may serve as retaining means for the heating box or the heating device, said girders being arranged along the two side walls 51 and, in the mounted state, each resting on a support section 61 of the skeleton forming the inner base 41.

The heating means of the heating device 37 is a diesel, kerosene or gasoline burner which is connected to a combustion air inlet 63 serving for intake of combustion air and to an exhaust gas air outlet 65 serving for blowing out exhaust gas, The burner is of a design known per se and is connected to a fuel tank 71, for example arranged outside the box 45, by means of a fuel line 69 which has a pump 67 and passes through a side wall 51—or, if necessary, through the floor 21. Said fuel tank is arranged, for example, in a cavity of a side wall or of the floor 21.

As is also evident from FIGS. 4 and 5, the combustion air inlet 63 and the exhaust gas outlet 65 are connected to an air supply line 73 or exhaust gas line 75. The latter can be led to the outside through two openings arranged in the adjacent side wall 51 in such a way that, in the attached state, the air supply line 73 points forward in the direction of travel and the exhaust gas line 75 points backward relative to the direction of travel and said lines are connected to the atmosphere surrounding the cabin vehicle 11.

As is also evident from FIG. 5, the exhaust gas line 75 may additionally have a sound absorbGr 77 extending over at least a part of its length.

Finally, the box 45 may additionally have a fire extinguisher 79 and a thermal resistance trigger which serves for releasing the extinguishing agent. Said trigger serves in particular for releasing the extinguishing agent when the temperature measured in the interior of the box 45 exceeds a predetermined limit, in which case the thermal resistance trigger preferably also switches off the above-mentioned burner.

A control circuit 81 illustrated by two blocks and having electrical and/or electronic components for measurement, control and regulation and a power source 83 forms part of the control means 39. Said potter source preferably consists of at least one chargeable battery (two batteries are shown in FIG. 4) for supplying electric power via the lines 84 to the control circuit 81 intended for controlling the heating process, the pump 67, the glow plug and the heating device 37. For controlling the heating process, the control circuit 81 is connected to the heating device and the fuel pump 67 and additionally to the fire extinguisher 79 by means of electrical connections indicated by arrows 85. The control means 39 furthermore has measuring means for measuring the air temperature in the heating device. The measuring means used here are temperature sensors which are connected to the control circuit 81.

Finally, the control means 39 may also have a control box 89 which is accessible from the outside and connected to the control circuit 81 via a line 87. Said control box is shown in FIG. 3 and contains manually operatable control members, for example a switch, a regulator for adjusting the interior cabin temperature, a filling nozzle for filling the fuel into the fuel tank 71 and possibly also analog and/or digital indication devices for indicating the interior cabin temperature and a connector device for charting the one or more batteries. The control means 39 may thus be formed so that the heating device, in particular the temperature regulation, can be controlled by manual operation of the stated control members by one person. For examples, the regulator for adjusting the interior cabin temperature can be designed for continuous temperature regulation.

Of course, the heating device described with reference to FIGS. 1 to 5 and the cableway cabin having such a heating device represent only a selection from several possible embodiments of the invention and can also be modified in various respects.

Thus, the cabin vehicle 11 can or course be designed not only for eight passengers but also for a smaller or larger number of passengers, for example For four, six, twelve, fifteen, etc. passengers.

In addition, it is of course also possible to design a heating means according to the invention in such a way that it can be retrofitted in a cabin vehicle of a cabin railway already in operation. For this purpose, the heating means and the fan device, the control means, the fire extinguisher and, if required, the fuel tank may likewise be attached by means of at least one box to the cabin housing, for example to the cabin floor.

I claim:

1. A cabin vehicle for a cable way, comprising a floor; two opposite end walls; two opposite side walls; and a heating system, the heating system comprising:

a heating device for circulating and warming up interior cabin air and having an air inlet, an air outlet, and heating means for warming up the interior cabin air passing through the heating device, and two air passage members provided in a cabin interior for circulating interior cabin air and arranged, respectively, next to the two opposite end walls, the two air passage members being connected with the air inlet and outlet of the heating device, respectively.

2. A cabin vehicle as claimed in claim 1, further comprising a box for holding the heating device and arranged substantially underneath an inner base of the cabine floor, the box having a shape of a rectangle and including a base, two vertically extending opposite end walls, two opposite side walls, and a cover forming a floor part.

3. A cabin vehicle as claimed in claim 2, further comprising two vertically extending benches provided at the two opposite end walls, the two air passage members being located under the two benches, respectively.

4. A cabin vehicle as claimed in claim 3, wherein the two air passage members project above the cabin floor.

5. A cabin vehicle as claimed in claim 2, wherein the two air passage members are attached at the two opposite end walls of the box.

* * * * *